United States Patent [19]

West

[11] 4,017,700

[45] Apr. 12, 1977

[54] MODULAR PRINTED CIRCUIT BOARD MOUNTABLE PUSH-BUTTON SWITCH WITH TACTILE FEEDBACK

[75] Inventor: William J. West, Los Altos, Calif.

[73] Assignee: Hewlett-Packard Company, Palo Alto, Calif.

[22] Filed: July 3, 1975

[21] Appl. No.: 593,078

[52] U.S. Cl. ..... 200/314; 200/340; 200/159 A; 240/25

[51] Int. Cl.[2] ..... H01H 3/12

[58] Field of Search ..... 116/DIG. 28; 240/2 S, 240/2 SP; 200/5 A, 5 D, 5 E, 340, 314, 159 R, 159 A

[56] References Cited

UNITED STATES PATENTS

| | | | |
|---|---|---|---|
| 2,546,086 | 3/1951 | Brockway | 200/314 |
| 3,100,822 | 8/1963 | Vermeulen | 200/159 A |
| 3,523,168 | 8/1970 | Holmes | 200/314 |
| 3,663,780 | 5/1972 | Golbeck | 200/314 |
| 3,691,985 | 9/1972 | Otterlei | 200/314 |
| 3,731,032 | 5/1973 | Schantz | 200/159 A |
| 3,786,205 | 1/1974 | Lien | 200/159 A |
| 3,808,389 | 4/1974 | Ramsay | 200/159 A |
| 3,908,100 | 9/1975 | Richard | 200/5 A |
| 3,916,150 | 10/1975 | Abernathy | 200/340 |
| 3,932,722 | 1/1976 | Obata | 200/340 |

FOREIGN PATENTS OR APPLICATIONS

| | | | |
|---|---|---|---|
| 459,647 | 1/1937 | United Kingdom | 200/314 |

*Primary Examiner*—Gerald P. Tolin
*Attorney, Agent, or Firm*—Patrick J. Barrett

[57] ABSTRACT

A push-button switch mechanism suitable for use with printed circuit boards is disclosed comprising a body that has a slidable plunger for actuating a cantilevered contact attached to the body. A button is attached to the plunger and when the button is depressed, the plunger deflects the cantilevered contact toward conductors on a printed circuit board to which the body is attached. A leaf spring in the body holds the plunger in an up or extended position and returns the plunger to this position after the button has been depressed. When the button is depressed the leaf spring is compressed along its longest axis and buckles, thereby providing tactile feedback. The switch may be provided with a light which is connected to the printed circuit board and is located in a cavity in the plunger. Illumination from the light may be seen through a translucent portion in the button.

9 Claims, 13 Drawing Figures

MODULAR PRINTED CIRCUIT BOARD MOUNTABLE PUSH-BUTTON SWITCH WITH TACTILE FEEDBACK

BACKGROUND OF THE INVENTION

Push-button switches are used in a wide variety of applications today, from single switches used to turn devices on and off to arrays of switches such as calculator and computer terminal keyboards. When an array of switches is required, it is often advantageous to use modular switches since they afford greater design flexibility and facilitate servicing. Prior art modular push-button switch assemblies usually comprise a body which contains the various switching components and which is fastened to a panel with screws or a nut. The switch is hand-wired to the circuitry it functions with after installation on a panel, and this hand-wiring is costly and mistake prone. In addition, most prior art push-button switch assemblies themselves are relatively complex and therefore relatively expensive to build due to the large number of small parts that must often be hand-assembled.

In many applications it is also desirable to provide a visual indication of the fact that a button has been pushed. This indication is usually provided either by a separate light bulb mounted on the panel near the switch or by a light bulb in the switch. A separate light bulb allows the switch to be simpler, but requires extra wiring and assembly. On the other hand, prior art switches containing light bulbs are even more complex than ordinary push-button switches and they, too, require extra handwiring.

SUMMARY OF THE INVENTION

According to a preferred embodiment of the present invention, a push-button switch comprises a molded plastic body and a molded plastic plunger that slides in the body. A push button is attached to the plunger, and a contact is cantilevered from the body so that when the button is pushed, the plunger deflects the cantilevered contact. The body is mounted directly to a printed circuit board having conductors situated beneath the cantilevered switch contact. When the contact is deflected by the plunger, it makes a bridging electrical connection between the conductors on the printed circuit board.

The plunger is held in an extended position when no force is applied to the button by a leaf spring retained in the body. When force is applied to the button, the leaf spring buckles as the plunger travels to its depressed position, thus providing the operator with tactile and audible feedback. A simple switch is thereby provided having tactile feedback but which requires no hand-wiring, since circuit connections are made to printed circuit conductors on the circuit board on which the switch is mounted. The push-button switch may also be provided with a light-emitting device which is connected to the printed circuit board and fits within a cavity in the plunger. The light from the light-emitting device shines through a transparent window in the push button.

DESCRIPTION OF THE PREFERRED EMBODIMENT

Figure 1:
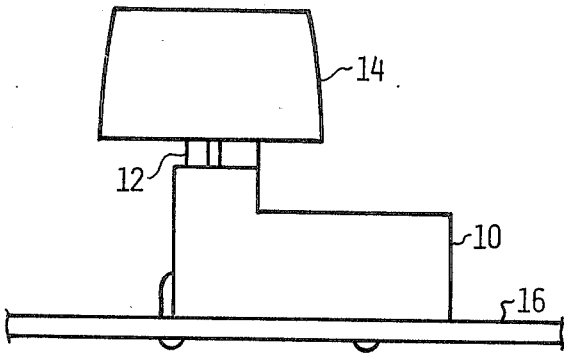
FIG. 1 shows a side elevation of the preferred embodiment of the present invention.
Figure 2:
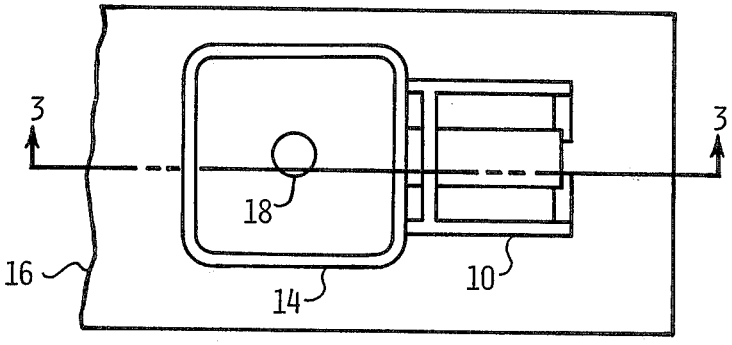
FIG. 2 shows a top view of the device of FIG. 1.

FIG. 1 shows a side elevation of a push-button switch having a body 10 with a plunger 12 and a push button 14 attached to the plunger. The body is mounted on a printed circuit board 16. The body may be molded, for example, from acetal plastic and the plunger, from polycarbon. FIG. 2 shows a top view of the same push-button switch with a window or clear portion 18 in push button 14 through which light may shine from a light-emitting device in the swtich. If it is not desired to have a lighted push-button switch, window 18 may, of course, be omitted from the push button.

Figure 3:
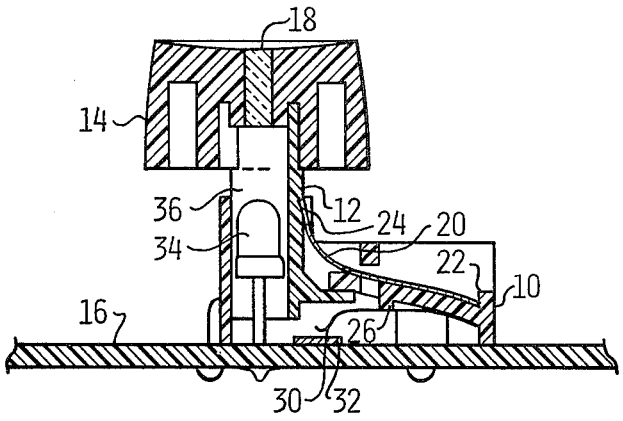
FIGS. 3 and 4 show sectional views of the device of FIG. 1.
Figure 4:
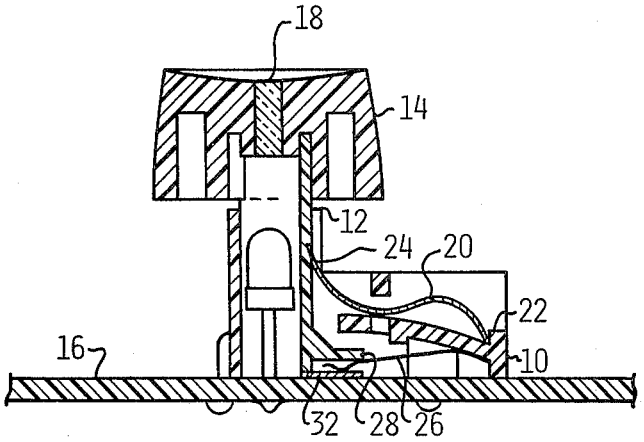

FIGS. 3 and 4 show sectional views of the switch shown in FIGS. 1 and 2. The plunger is held in an extended position as shown in FIG. 3 by a leaf spring 20 which is situated between an abutment 22 in the body and an abutment 24 on the plunger and may be made of a high carbon steel for optimum spring qualities. A cantilevered contact 26, made of Beryllium-copper, for example, is mounted to the body beneath a tab 28 on the plunger. Immediately beneath a contact portion 30 of contact member 26 there is a printed circuit board conductor or pad 32 on printed circuit board 16. Also shown mounted on printed circuit board 16 is an optional light-emitting diode 34 which is located in a cavity 36 in the plunger.

As can be seen in FIG. 4, when force is applied to push button 14, the plunger slides in body 10 until it comes into contact with printed circuit board 16. As the plunger moves to this depressed position, tab 28 pushes contact 26 into electrical connection with printed circuit board pad 32. In addition, as plunger 12 moves from its extended to its depressed position, abutment 24 moves closer to abutment 22, thus placing a compressive force on leaf spring 20, causing the spring to buckle.

Figure 5:
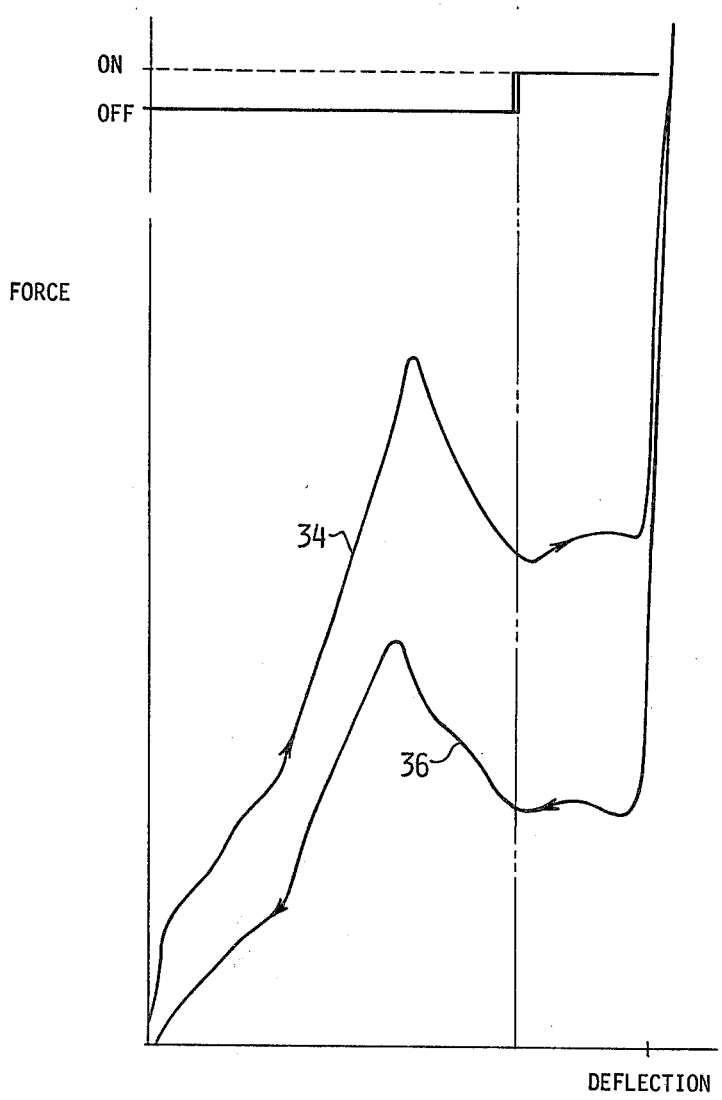
FIG. 5 is a force-deflection curve for the preferred embodiment.

The buckling action of the leaf spring produces a dip in the force deflection characteristics of the switch as shown in FIG. 5. In the lower portion of the graph, force applied to the push button is plotted against the deflection of the plunger. Line 34 shows the force deflection characteristic as the push button moves downward, and line 36 shows the same characteristic as the button moves back upward to the extended position. As can be seen from the graph, there is a very definite dip in the force deflection curve which provides the operator with tactile, and usually audible, feedback. The upper portion of the graph shows when contact 26 makes connection with the printed circuit board pad 32, the switch being considered "off" when there is no contact and "on" when there is contact. It can be seen by comparing the lower and upper portions of the graph that connection is made at approximately the bottom of the dip in the force deflection curve, so that the switch is actually closing when the operator receives the tactile feedback.

Figure 6:
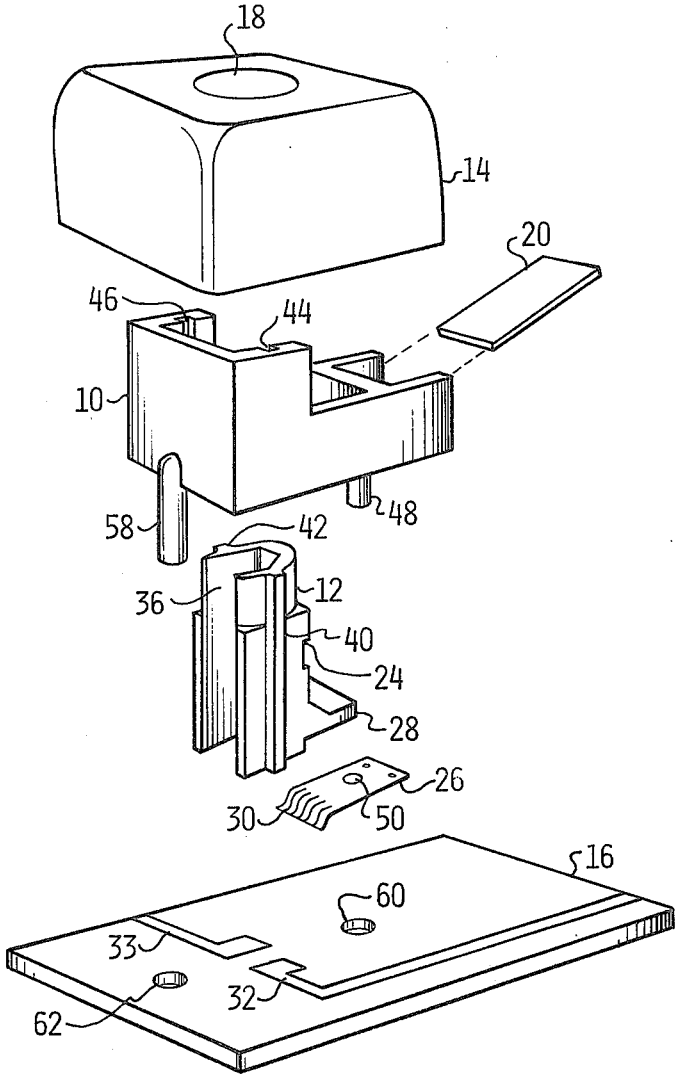
FIG. 6 shows an exploded view of the preferred embodiment.
Figure 7:
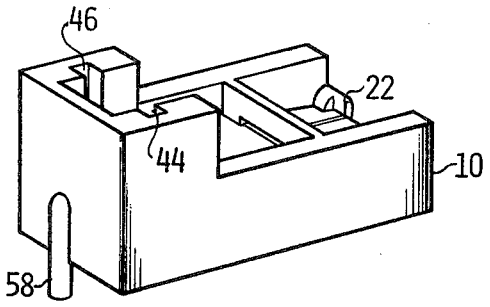
FIGS. 7 and 8 show perspective views of the body of the preferred embodiment.
Figure 8:
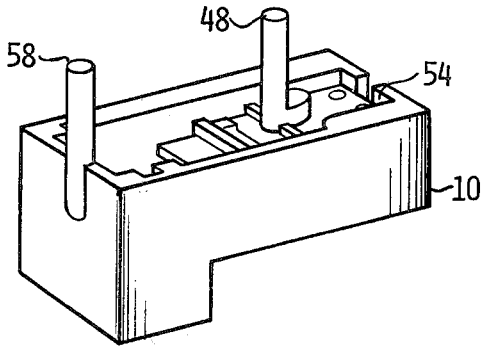
Figure 9:
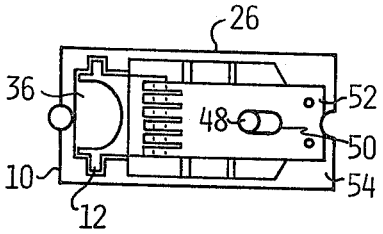
FIG. 9 is a bottom view of the preferred embodiment.

FIG. 6 shows an exploded view of the push-button switch. Plunger 12 has ribs 40 and 42 which engage slots 44 and 46 respectively in body 10. These ribs allow the plunger to slide in the body without rotating. When the switch is assembled, the plunger is inserted in the body; and then the leaf spring is inserted in the body so that it rests against abutments 22 and 24. Abutment 22 can be seen even more clearly in FIG. 7 showing the body alone. Next, contact 26 is placed over a post 48 on the bottom of body 10 and a hole 50 in contact 26 engages post 48, and end 52 abuts against a portion 54 of body 10. The bottom portion of body 10 is shown more clearly in FIG. 8 and the placement of the contact in the body is shown in FIG. 9.

Figure 10:
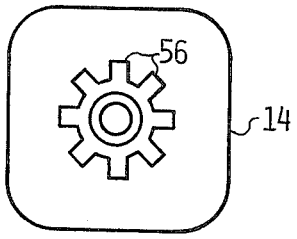
FIG. 10 is a bottom view of a button.

Push button 14 is then pressed on to plunger 12. As shown in FIG. 10, push button 14 has a number of slots 56 which engage ribs 40 on plunger 12. The slots 56 are oriented so that the key can be oriented as desired at 45 degree increments. The assembled switch mechanism is then attached to a printed circuit board 16. Body 10 has two posts 48 and 58 which are inserted in holes 60 and 62 in the printed circuit board and may be heat-staked or fastened in another appropriate fashion to hold the body to the printed circuit board.

Figure 11:
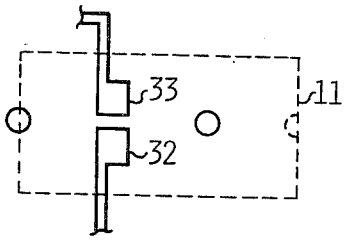
FIGS. 11, 12 and 13 are plan views of printed circuit conductors for use with the preferred embodiment.
Figure 12:
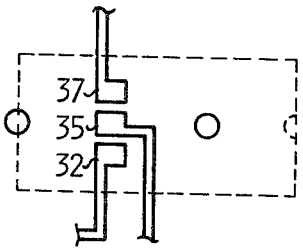
Figure 13:
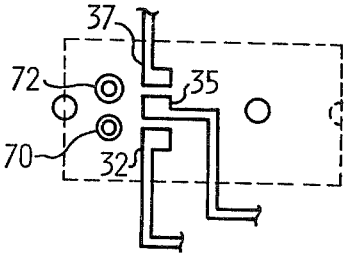

FIS. 11, 12 and 13 show a variety of possible arrangements of printed circuit board conductors or pads for making connection with contact 26. In FIG. 11 two pads 32 and 33 are shown situated within the dotted rectangle 11 indicating the outline of body 10. When the push button is depressed, contact 26 forms a bridging connection between the two printed circuit pads. To insure good electrical connection, contact 26 has a plurality of fingers which each make contact with the printed circuit board pad. In addition, these fingers make a rubbing contact with the printed circuit board pad as they are deflected since they are cantilevered at one end and are pushed against the pads on the printed circuit board so that they flex. FIG. 12 shows an alternative arrangement having three printed circuit board pads 32, 35, and 37. All three of these pads are bridged together when the push button is deflected thus making a double-pole, single-throw switch. FIG. 13 shows a contact arrangement similar to that shown in FIG. 12 with two plated-through holes 70 and 72. A light-emitting diode may be soldered into these holes to provide a lighted push-button lamp. The diode itself fits in the cavity 36 in the plunger as described above and the diode is energized by other circuitry (not shown).

I claim:

1. A push-button switch mechanism comprising:

a body having a passage and a support member therein;

a cantilevered contact member mounted in the body;

a plunger slidably mounted in the body passage and having a tab for engaging and deflecting the contact member when the plunger is moved from an extended to a depressed position;

a button attached to the plunger for moving the plunger from the extended to the depressed position when force is applied to the button; and a leaf spring retained in the body and supported along a portion of its length by the support member having a first end abutting an abutment in the body and a second end abutting an abutment on the plunger for holding the plunger in the extended position when no force is being applied to the button, the plunger forcing the first end of the leaf spring toward the second end of the leaf spring along a longitudinal axis thereof and causing the leaf spring to buckle when the plunger is moved from the extended to the depressed position in response to force being applied to the button to provide tactile feedback indicating that the plunger has been depressed, and the leaf spring forcing the plunger back to the extended position when force is removed from the button.

2. A push-button switch mechanism as in claim 1 further comprising a substrate fastened to the body and having a first and a second conductor supported thereon, the first and second conductors being situated in registration with the contact member and the contact member making a bridging electrical connection between the first and second conductors when the plunger is in the depressed position.

3. A push-button switch mechanism as in claim 2 wherein the plunger has a cavity along the direction of movement of the plunger; the button has a light transmitting portion aligned with the plunger cavity; and the switch mechanism further comprises a light-emitting device mounted on the substrate and filling a portion of the plunger cavity.

4. A push-button switch mechanism as in claim 1 wherein the body passage has a groove along the direction of movement of the plunger and the plunger has a rib that rides in the groove to prevent twisting of the plunger.

5. A push-button switch mechanism as in claim 1 wherein the leaf spring is curved in a first direction about a first axis normal to the axis between the first and second ends when the plunger is in the extended position and the leaf spring curves in a second direction about a second axis parallel to the first axis when the plunger is in the depressed position.

6. A push-button switch mechanism as in claim 3 wherein:

the substrate is a printed circuit board;

the first and second conductors are printed circuit conductors on the printed circuit board;

the printed circuit board has light mounting holes with conductive surfaces connected to conductors on the printed circuit board, the light mounting holes being aligned with the plunger cavity; and the light-emitting device has electrical leads which are mechanically and conductively secured in the light mounting holes.

7. A push-button switch mechanism as in claim 6 wherein:

the light-emitting device is a light-emitting diode mounted on at least one of the electrical leads and the electrical leads are soldered in the light mounting holes.

8. A push-button switch mechanism as in claim 1 wherein:

the body includes a stop and the tab on the plunger engages the stop to limit the upward travel of the plunger.

9. A push-button switch mechanism as in claim 2 wherein:

the body is a molded plastic unit having a plurality of integral posts depending therefrom;

the substrate has a plurality of switch mounting holes formed therein; and the posts are fastened in the switch mounting holes to attach the body of the substrate and to position the cantilevered contact member in alignment with the first and second conductors.

* * * * *